United States Patent [19]

Shinozuka

[11] 4,228,759

[45] Oct. 21, 1980

[54] PRESSURE-SUSTAINING VESSEL

[76] Inventor: Masanobu Shinozuka, 229 Oak St., Ridgewood, N.J. 07450

[21] Appl. No.: 903,061

[22] Filed: May 5, 1978

[51] Int. Cl.[2] ..... B63G 8/00

[52] U.S. Cl. ..... 114/342

[58] Field of Search ..... 114/312, 324, 335, 339, 114/341, 342; 220/406, 420, 426; 244/118 P; 98/1.5; 405/185, 193; 137/81, 184, 256

[56] References Cited

U.S. PATENT DOCUMENTS

| | | | |
|---|---|---|---|
| 1,879,735 | 9/1932 | D'Albay | 114/342 |
| 3,555,834 | 1/1971 | Weston | 405/185 |
| 3,592,120 | 7/1971 | Goetz | 220/426 |

*Primary Examiner*—Charles E. Frankfort

*Assistant Examiner*—Jesus D. Sotelo

*Attorney, Agent, or Firm*—Montague & Ross

[57] ABSTRACT

A vessel designed for deep-sea diving or for outer-space exploration has a hull divided into a multiplicity of concentric spherical shells separated by clearances in which air or some other fluid is maintained at a pressure constituting a fraction of the overall pressure differential between the interior of the vessel and the surrounding body of water or empty space. The fractional pressures, whose sum equals the overall differential, can be maintained by valves closing whenever the predetermined fractional differential of the respective clearance is reached; alternatively, a controller responsive to signals from individual pressure sensors in the several clearances can control a pressure pump with separate outlets to these clearances.

6 Claims, 4 Drawing Figures

PRESSURE-SUSTAINING VESSEL

FIELD OF THE INVENTION

My present invention relates to a vessel, such as a bathysphere or a spacecraft, designed to be used under conditions in which its internal pressure differs greatly from the ambient.

BACKGROUND OF THE INVENTION

Vessels designed for deep-sea diving, whether manned or unmanned, must have strong hulls adapted to withstand a pressure differential of tens of atmospheres. Welding and other steps necessary in the manufacture of such hulls and in their testing are difficult to perform if the hulls exceed a certain thickness. On the other hand, these hulls should be as free as possible from defects in order to insure the safety of their occupants and/or instruments.

OBJECT OF THE INVENTION

The object of my present invention, accordingly, is to provide a vessel construction in which these difficulties are largely obviated.

SUMMARY OF THE INVENTION

I realize this object, pursuant to my present invention, by constructing the hull of such a vessel from a multiplicity of concentrically nested shells, preferably of spherical shape, separated by intervening clearances that are occupied by a fluid under pressure. The fluid, which in the case of a bathysphere could be water, is pressurized by pressure-control means to maintain the individual pressure in each inter-shell clearance at a fractional value of the overall pressure differential existing between the interior of the innermost shell and the outside, as determined by sensing means in the hull. Thus, each shell need not sustain more than a fraction of the overall pressure differential and can therefore be made relatively thin-walled, the requisite wall thickness varying inversely with the number of shells.

With n shells and an overall pressure differential $\Delta P = P_x - P_o$ where $P_x$ is the external pressure and $P_o$ is the internal one (usually about one atmosphere), each shell will be subjected only to a fractional pressure differential $\delta P = \Delta P/n$ in an idealized case in which all these differentials are equal. Actually, if the shells are all of the same wall thickness, the inner shells can be more strongly loaded than the outer ones by virtue of their smaller radius of curvature. In practice, of course, each shell should be capable of sustaining a load greater than that to which it will theoretically be subjected. Advantageously, its safety margin should be sufficient to withstand the extra pressure which would act on it upon failure of an adjoining shell.

The means of controlling the individual pressures in the several clearances may take various forms. In one mode of realization, each shell except one has a port closable by a valve which goes into action when a sensor detects that the pressure difference effective across an adjoining shell on the side of the lower pressures reaches a predetermined threshold; the exempted shell forms a boundary of the concentric array and defines the low-pressure surface of the hull, i.e. its inner surface in the case of a vessel used under water. Such a system has the advantage of structural simplicity but operates only in steps, with a progressive increase in the number of shells placed under load as the overall pressure differential rises. An alternate solution, allowing a substantially uniform loading of all the shells regardless of the magnitude of differential $\Delta P$, utilizes a source of pressure fluid with individual connections to the several clearances to build up the desired fractional pressures therein.

BRIEF DESCRIPTION OF THE DRAWING

The above and other features of my present invention will now be described in detail with reference to the accompanying drawing in which.

SPECIFIC DESCRIPTION

Figure 1:
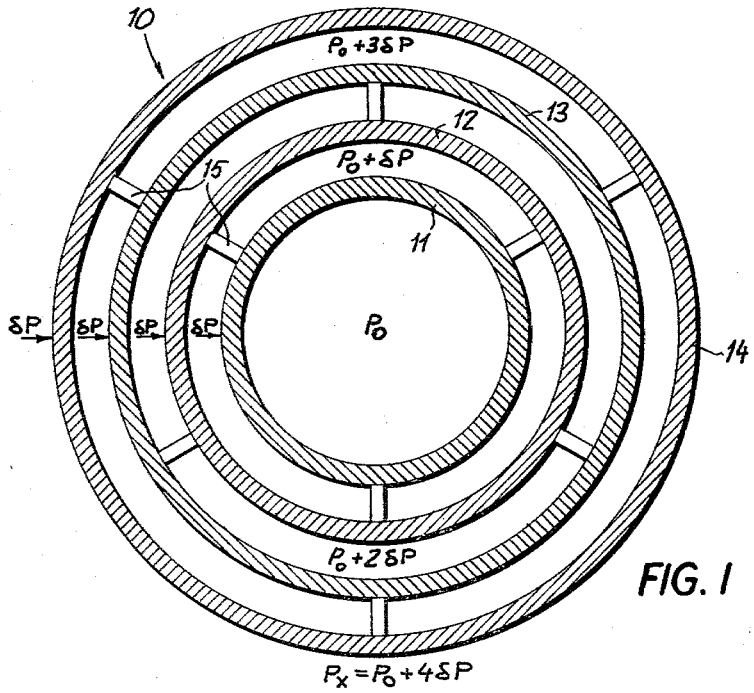
FIG. 1 is a somewhat diagrammatic cross-sectional view of a vessel embodying my invention.

In FIG. 1 I have shown the hull 10 of a vessel according to my invention, such as a bathysphere, comprising a multiplicity of concentrically nested spherical cells 11, 12, 13 and 14 which are held separated by spacers 15. A pressure $P_o$ of about one atmosphere prevails in the central space inside the innermost shell 11 which may be occupied by human operators as well as by various instruments not shown. The shells are provided with the necessary doors and windows which have not been illustrated; the interior of cell 11 may also communicate through a hose with the atmosphere as is usual in diving equipment.

In accordance with my present invention, the clearances between shells 11–14 are occupied by a gas or a liquid at staggered pressures all lying between the internal pressure $P_o$ and the external pressure $P_x$. In this specific instance, the overall pressure differential $\Delta P$ is subdivided into four fractional differentials $\delta P$ so that $P_x = P_o + 4\delta P$; the three inter-shell clearances, counting from the inside out, are maintained at respective pressures $P_o + \delta P$, $P_o + 2\delta P$ and $P_o + 3\delta P$. Thus, each shell is subjected only to an inwardly acting pressure difference $\delta P$.

Figure 2:
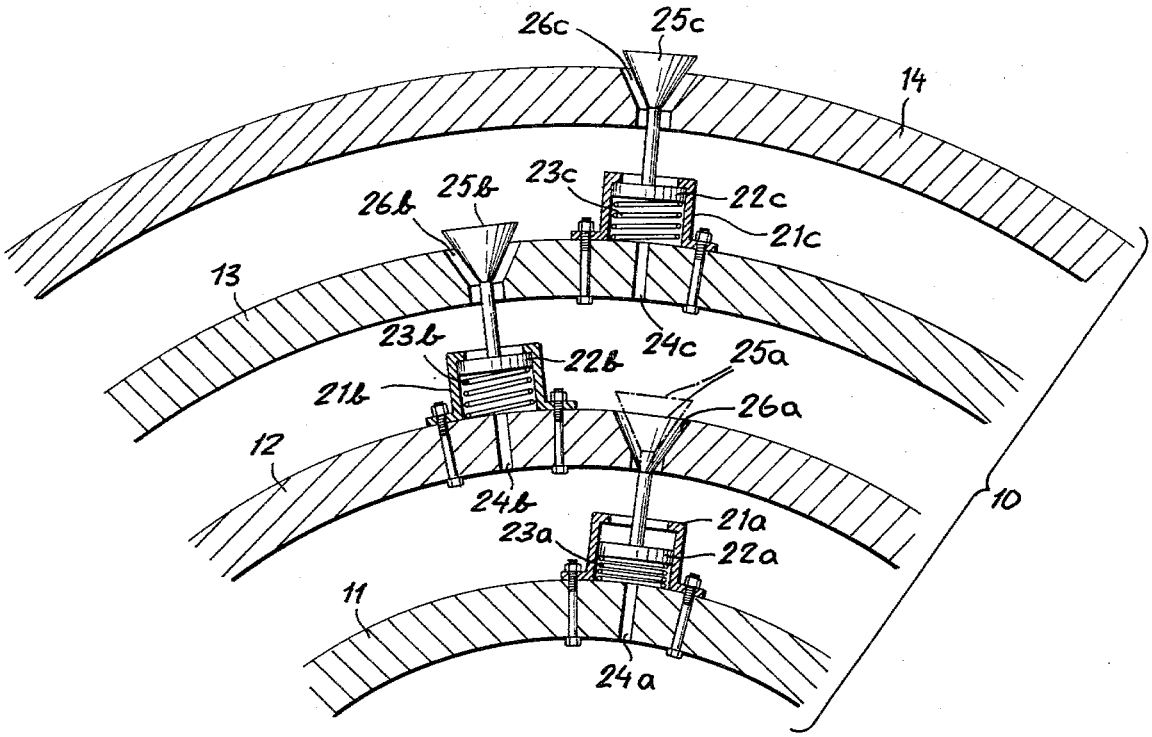
FIG. 2 is a partial sectional view of the vessel of FIG. 1, drawn to a larger scale and showing pressure-control means according to one embodiment.

In FIG. 2 I have shown the three innermost shells 11, 12 and 13 provided with respective cylinders **21*a*, 21*b*, 21*c* accommodating pistons 22*a*, 22*b*, 22*c*. The piston heads, which form an airtight seal with their associated cylinders, are biased outwardly by springs 23*a*, 23*b*, 23*c* urging them with a force equal to $\delta P$ against a seat on the inner cylinder periphery. The cylinder compartments containing the springs 23*a*–23*c* communicate via respective orifices 24*a*, 24*b*, 24*c* with the low-pressure sides of the corresponding shells. Each piston is rigid with a respective valve 25*a*, 25*b*, 25*c* lodged in a port 26*a*, 26*b*, 26*c* of the immediately adjoining outlying shell 12, 13 or 14**.

As long as the pressure differential across any of shells 11–13 is less than the spring force, the associated valves are open as illustrated for valves **25*b* and 25*c*. Pressure fluid, i.e. sea water in the case of a submerged vessel, then enters into the clearances between the shells until it is stopped either by the innermost piston 22*a*** or by a closed valve ahead of it.

In this specific example, valve 25*a* closes as soon as the vessel has descended to about one-fourth its ultimate depth so that the water pressure overcomes the force of spring 23*a*, causing the valve 25*a* to close. From that point on, the pressure between shells 11 and 12 has the value $P_o+\delta P$ indicated in FIG. 1. After a similar further descent, piston 22*b* is thrust inwardly by the rising water pressure to close the valve 25*b*; the pressure in the clearance between shells 12 and 13 is now stabilized at the value $P_o+2\delta P$. When the vessel has descended to three-fourths its final depth, the force of spring 23*c* is also overcome with resulting closure of valve 25*c*. At the end of the full descent, the pressure difference existing across the outer shell 14 substantially equals that present across each of the three other shells 11–13.

Upon the subsequent ascent, the valves are opened in the reverse order of their closure.

Figure 3:
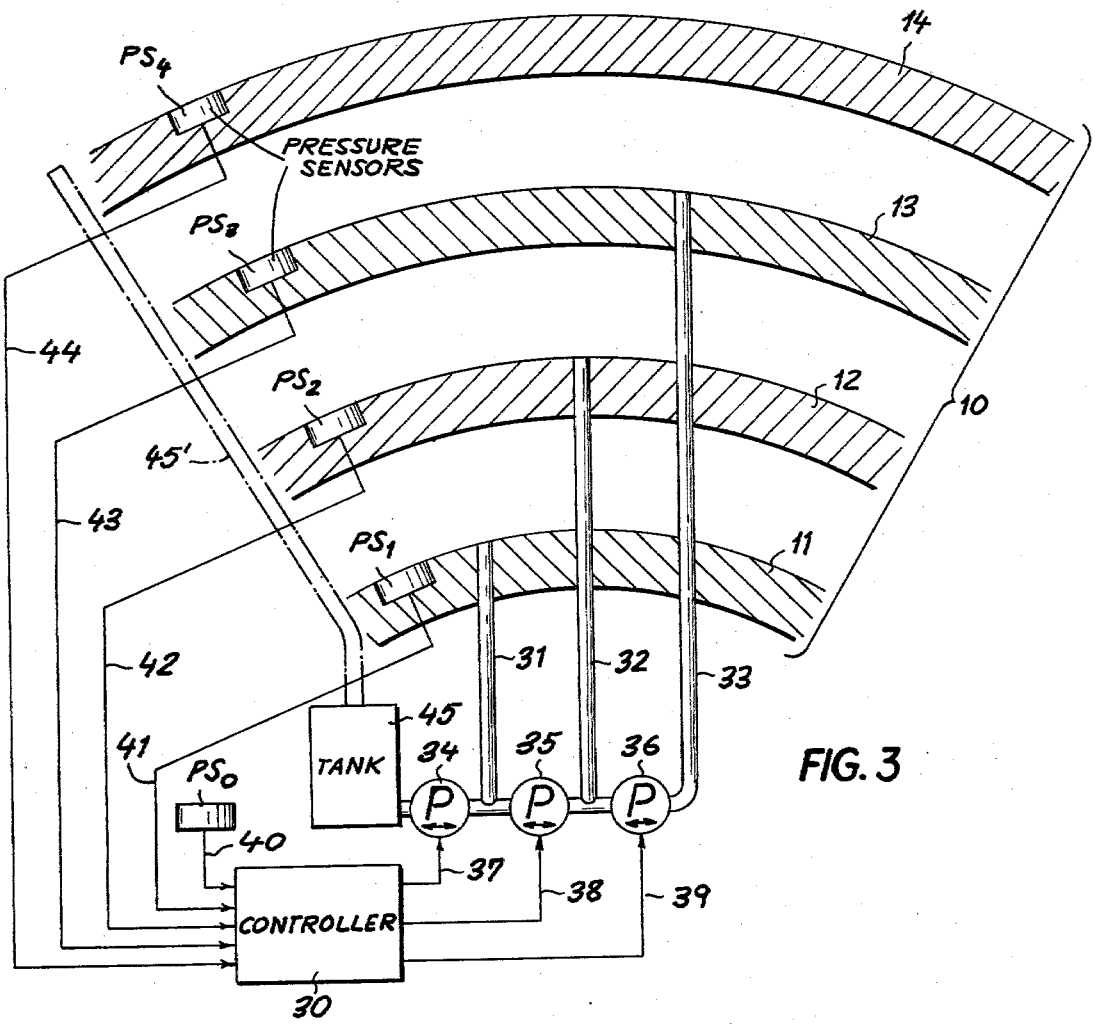
FIG. 3 is a view similar to FIG. 2 but showing pressure-control means according to another embodiment.

In FIG. 3, shells 11, 12 and 13 are shown penetrated by respective conduits 31, 32 and 33 communicating with entrance/exit ports of cascaded reversible gear pumps 34, 35, 36 whose motors (not shown) are actuatable by output lines 37, 38, 39 of a controller 30. Pressure sensors $PS_0$ in the space surrounded by hull 10 and $PS_1$, $PS_2$, $PS_3$, $PS_4$ on shells 11–14 are connected by respective input leads 40–44 to controller 30 in order to set up staggered fluid pressures in the inter-shell clearances as described above. The pressure fluid, in this instance, may be drawn from the air in the working space bounded by shell 11, from a separate storage tank 45 as shown in FIG. 3, or from the outside as shown at 45'.

Figure 4:
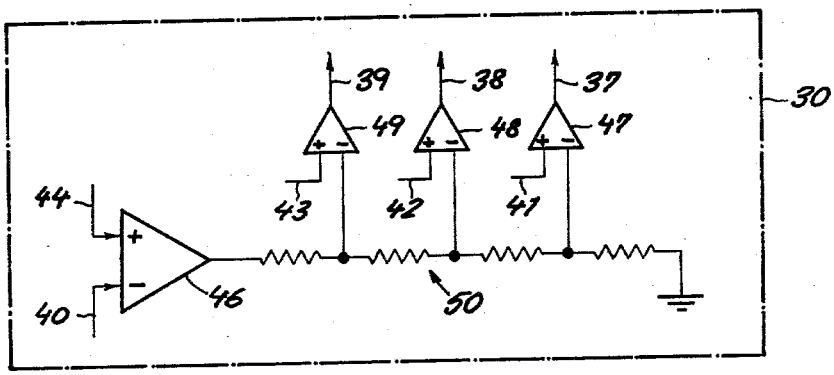
FIG. 4 is a circuit diagram of a controller forming part of the system of FIG. 3.

The controller 30 may be constructed as shown in FIG. 4, comprising a differential amplifier 46 with a positive and a negative input respectively connected to leads 40 and 44 so as to produce an output voltage proportional to the pressure differential $\Delta P$. Other differential amplifiers 47, 48, 49 with positive inputs connected to leads 41, 42, 43 and negative inputs connected to respective taps of a voltage divider 50 emit stepped-down voltages on output leads 37, 38, 39 for the control of pumps 34, 35, 36. A positive voltage on any of these output leads causes the associated pump to rotate in a sense intensifying the pressure in the clearance communicating with the respective discharge conduit 31, 32 or 33; a negative output voltage has the opposite effect. The system of FIGS. 3 and 4, accordingly, adapts itself to the overall pressure differential $\Delta P$ with substantially uniform loading of all the shells by proportional pressure differences $\delta P$.

The system shown in FIG. 1 applies also to the case where the external pressure $P_x$ is less than the internal pressure $P_o$, as with a spacecraft where $P_x=0$ and $P_o=\Delta P=1$ atmosphere. In this case, of course, the direction of the arrows representing the pressure difference $\delta P$ would have to be reversed. The system of FIGS. 3 and 4 can be used without significant changes also in such a situation. The arrangement of FIG. 2, however, would have to be modified by inverting the pistons and valves, the latter being then received in ports of the three innermost shells 11–13.

Obviously, either embodiment can be utilized with any number of shells.

I claim:

1. A vessel for deep-sea diving designed to sustain a pressure differential between its interior and its surroundings, comprising:

a hull formed from a multiplicity of concentrically nested shells including an innermost shell and several outer shells separated by intervening fluid-filled clearances;

sensing means in said hull for determining the pressure prevailing in each of said clearances; and pressure-control means responsive to said sensing means for admitting sea water from outside said hull into said clearances under pressures corresponding to a fractional value of the overall pressure differential between the interior of the innermost shell and the outside, the sum of the water pressures in said clearances equaling said overall pressure differential.

2. A vessel as defined in claim 1 wherein said shells are spherical.

3. A vessel as defined in claim 1 or 2 wherein said pressure-control means comprises a valve in a port of each outer shell of said hull, said sensing means comprising an individual pressure sensor for each valve subjected to the pressure difference effective across an adjoining shell surrounded by the respective outer shell.

4. A vessel as defined in claim 3 wherein said pressure sensor comprises a spring-loaded plunger connected with each valve and a cylinder surrounding said plunger, said cylinder being mounted on a shell surrounded by the one provided with the respective valve, said surrounded shell having an opening communicating with said cylinder.

5. A vessel as defined in claim 1 or 2 wherein said pressure control means comprises pump means communicating with the exterior of said hull.

6. A vessel designed to sustain a pressure differential between its interior and it surroundings, comprising:

a hull formed from a multiplicity of concentrically nested shells separated by intervening fluid-filled clearances, said shells including a boundary shell defining a low-pressure side of said hull;

a valve in a port of each shell except said boundary shell;

a spring-loaded plunger connected with each valve; and a cylinder surrounding said plunger, said cylinder being mounted on a shell adjoining the one provided with the respective valve on the low-pressure side of the latter, said adjoining shell having an opening communicating with said cylinder for subjecting said plunger to the pressure difference effective thereacross, the spring force acting upon each plunger being calibrated to maintain the individual pressure in each of said clearances at a fractional value of the overall pressure differential between the interior of the innermost shell and the outside, the sum of the individual pressures in said clearances equaling said overall pressure differential.

* * * * *